United States Patent [19]

Mattesky

[11] Patent Number: 4,557,062

[45] Date of Patent: Dec. 10, 1985

[54] FORM FITTING IRONING BOARD COVER

[75] Inventor: Henry Mattesky, Cedar Grove, N.J.

[73] Assignee: Magla Products, Irvington, N.J.

[21] Appl. No.: 742,181

[22] Filed: Jun. 7, 1985

[51] Int. Cl.[4] ..... D06F 83/00

[52] U.S. Cl. ..... 38/140

[58] Field of Search ..... 38/140, 66

[56] References Cited

U.S. PATENT DOCUMENTS

| | | | |
|---|---|---|---|
| 457,033 | 8/1891 | Sanders | 38/140 |
| 2,026,961 | 1/1936 | Brodt | 38/140 |
| 2,418,969 | 4/1947 | Di Gesare | 38/140 |
| 2,811,795 | 11/1957 | Ashley | 38/140 |
| 3,007,267 | 11/1961 | Goldsmith | 38/140 |
| 3,562,934 | 2/1971 | Cogar | 38/140 |

FOREIGN PATENT DOCUMENTS

| | | | |
|---|---|---|---|
| 1173464 | 12/1969 | United Kingdom | 38/140 |

*Primary Examiner*—Werner H. Schroeder
*Assistant Examiner*—Andrew M. Falik
*Attorney, Agent, or Firm*—Omri M. Behr

[57] ABSTRACT

A form-fitting cover for use on an ironing board having nose and heel envelopes formed with a pad sheet attached to the lower surface of an ironing surface sheet whereby the ironing surface sheet is automatically properly positioned when the nose and heel envelopes are fitted onto the ironing board.

10 Claims, 11 Drawing Figures

FORM FITTING IRONING BOARD COVER

BACKGROUND OF THE INVENTION

Ironing is the bane of the housewife's existence. Despite the technological advances made by fabric and clothing manufacturers, there still exists in virtually every household a tongue-shaped board which is used daily, weekly or monthly to banish wrinkles from the garments one wears. While the iron and starch descendents of today bear little resemblance to their early ancestors, time has stood still for the lowly iron board. The greatest advances for it heretofore have involved new materials for its covers and pads. The covers and pads have remained of basically the same design. The cover is a flat piece of material, hemmed on all sides and having a drawstring disposed in the hem to tighten the cover around the board. This drawstring design is necessitated by the slight variation of the sizes and shapes of ironing boards in common household use. Of course, while tightening the cover, one must simultaneously maneuver the pad so that it remains on the top of the board rather than sliding sideways or forwardly over the edges of the board. Most homemakers, given the choice of replacing a warn-out board cover or using the old one "a bit longer", will get several months use out of the holely cover before tackling the much less-than-delightful chore of replacement.

The present invention relates to a form-fitting cover for ironing boards. More particularly, the present invention is directed to an ironing board cover which can easily be fitted onto standard shaped ironing boards.

SUMMARY OF THE INVENTION

The form fitting ironing board cover of the present invention comprises a substantially non-elastic fabric ironing surface sheet (the cover portion) and a stretchable, substantially heat resistant pad sheet disposed below said surface sheet (the pad portion), the pad portion also contains a nose and heel portion affixed thereto.

The surface sheet (cover portion) is dimensioned to be larger than a standard ironing board so that when fitted to such a board it will fit over the upper surface thereof around its edges and just around the perimeter of its lower surface.

The pad sheet (suitably a foam sheet) is sized so as to have a breadth dimension substantially equal to that of the breadth dimensions of the board but having a length dimension between about 0.5% and about 10% less than that of the board. The pad can be made of any heat-resistant material with proper cushioning characteristics such as urethane foam, silicone rubber foam, needle punched rayon or cotton; but the preferred material is urethane foam due to its combination of stretchability and cushioning characteristics.

The nose portion envelopes a minor forward arcuate segment of the pad sheet and is rigidly affixed to the pad sheet around a portion of the periphery of the curved edge of the arc. Additionally, the nose portion is affixed to the surface sheet at at least one position along the periphery of the curved edge of the arc. The nose portion contains reinforcing means located rearwardly of at/or forwardly of the rearward edge of the nose portion at the common peripheral edge of the nose portion and the pad sheet.

The heel portion envelopes a minor rearward arcuate segment of the pad sheet around a portion of the periphery of the curved edge of the arc. Additionally, the upper face of the heel portion is affixed to the lower face of the surface sheet at at least one position on the heel portion. The point of attachment is located forwardly of the rearward edge of the heel portion. The heel portion contains reinforcing means located rearwardly of at/or forwardly the forward edge of the heel portion at the common peripheral edge of the heel portion and the pad sheet.

When the nose portion of the ironing board is inserted into the nose portion of the pad sheet and the heel portion of the board is slipped into the heel portion of the pad sheet by rearwardly pulling the heel portion of the pad sheet, the elasticity of the pad sheet causes the pad sheet to snuggly fit onto the board. The surface sheet, by virtue of its being attached to the pad sheet in the heel and the nose portions thereof, is automatically properly positioned onto the board.

DETAILED DESCRIPTION OF THE INVENTION

Figure 1:
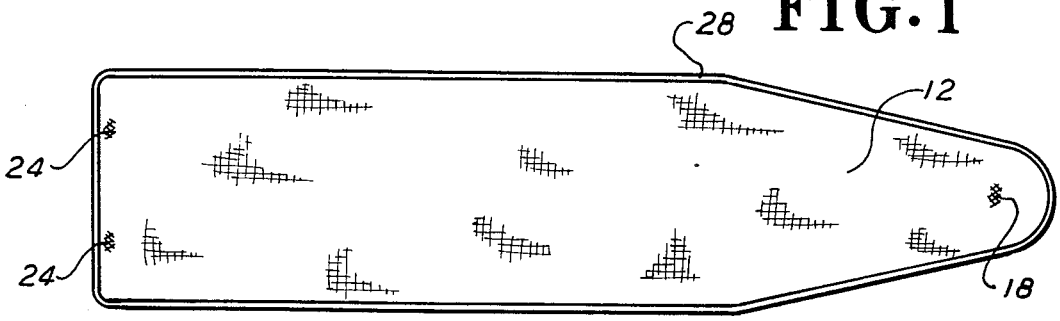
FIG. 1 is a downward plan view of the upper face of a cover according to the invention.

While this invention is susceptible of embodiment in many different forms, there is shown in the drawings and will herein be described in detail, preferred embodiments of the invention with the understanding that the present disclosure is to be considered as an exemplification of the principles of the invention and is not intended to limit the invention to the embodiment shown.

Figure 2:
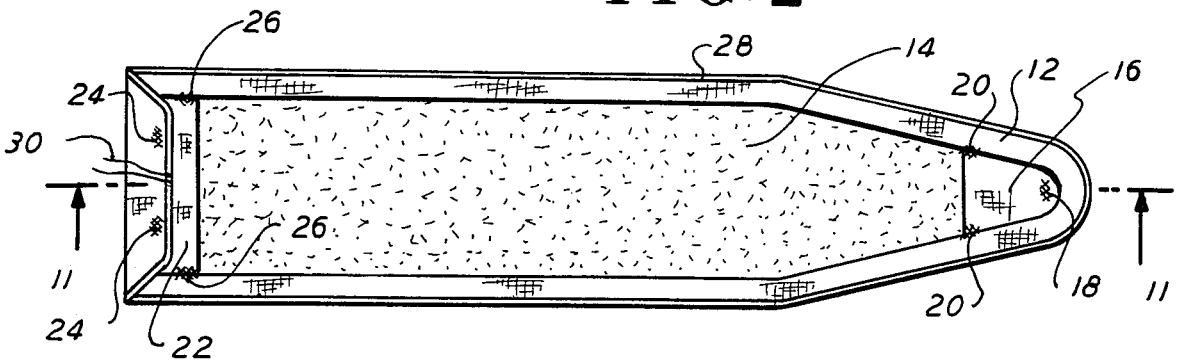
FIG. 2 is a downward plan view of the lower face of a cover.
Figure 3:
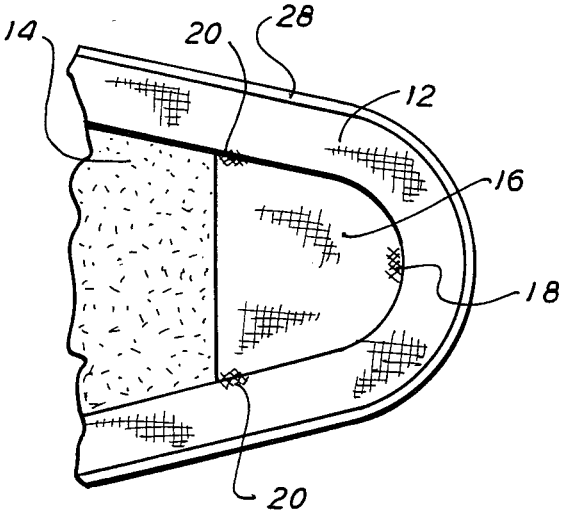
FIG. 3 is a fragmentary portion of the nose end of a cover.

FIGS. 1 and 2 represent the upper and lower faces of a cover according to the present invention. The cover comprises a substantially non-elastic fabric ironing surface 12 and a stretchable, substantially heat resistant pad sheet 14, disposed below said surface sheet 12. A nose portion 16 envelopes a minor forward arcuate segment of the pad sheet 14. This nose portion 16 is rigidly peripherally affixed to the pad sheet 14 and additionally is affixed to the surface sheet 12 at at least one position 18. Forward reinforcing means 20 are located forwardly of the rearward edge of the nose portion 16 at the common peripheral edge of the nose portion 16 and the pad sheet 14. A heel portion 22 envelopes a minor rearward arcuate segment of the pad sheet 14. This heel portion 22 having a rearward segment, said segment is rigidly peripherally affixed to the pad sheet 14 and additionally is affixed to the lower face of the surface sheet 12 at at least one position 24 on the heel portion 22, position 24 being located forwardly of the rearward edge of the heel portion 22. Rearward reinforcing means 26 are located rearwardly of the forward edge of the heel portion 22 at the common peripheral edge of the heel portion 22 and the pad sheet 14.

Optionally, as shown in FIGS. 1, 2, 3, 4, 6 and 8, the cover may contain a drawstring housing 28 around the circumference of the surface sheet 12 and a drawstring 30 therein to be used for securing the cover to the ironing board. In the absence of a drawstring, an elastic material may be affixed to the circumference of the surface sheet to secure the cover to the ironing board.

The substantially non-elastic fabric ironing surface sheet 12 may be of a wide variety of materials commonly utilized for such a purpose. It may be, for instance, cotton duck, linen, broadcloth or of the teflon-coated fabric. It can be optionally colored or printed to make it more consumer-acceptable. The surface sheet is dimensioned to be larger than a standard ironing board so that when fitted to such a board it will fit over the upper surface thereof around its edges and just around the perimeter of its lower surface.

The stretchable, substantially heat resistant pad sheet 14 can likewise be any of a variety of such pads typically available. The pad sheet 14 is sized so as to have a breadth dimension substantially equal to that of the breadth dimensions of a standard ironing board but having a length dimensions between 0.5% and 10% less than that of a standard ironing board. Preferably, the length dimension will be between 2.5% and 5% less than that of a standard ironing board. The precise percentage by which the length of the pad sheet 14 is undersized will depend upon the elasticity of the particular material being utilized for the pad sheet 14.

Figure 4:
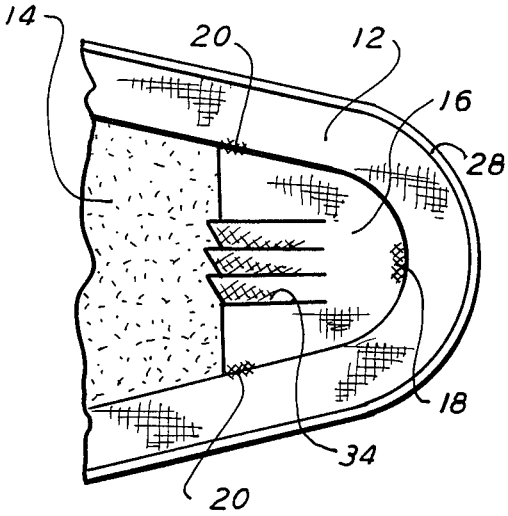
FIG. 4 is a fragmentary portion of the nose end of a cover having a pleated nose portion.
Figure 6:
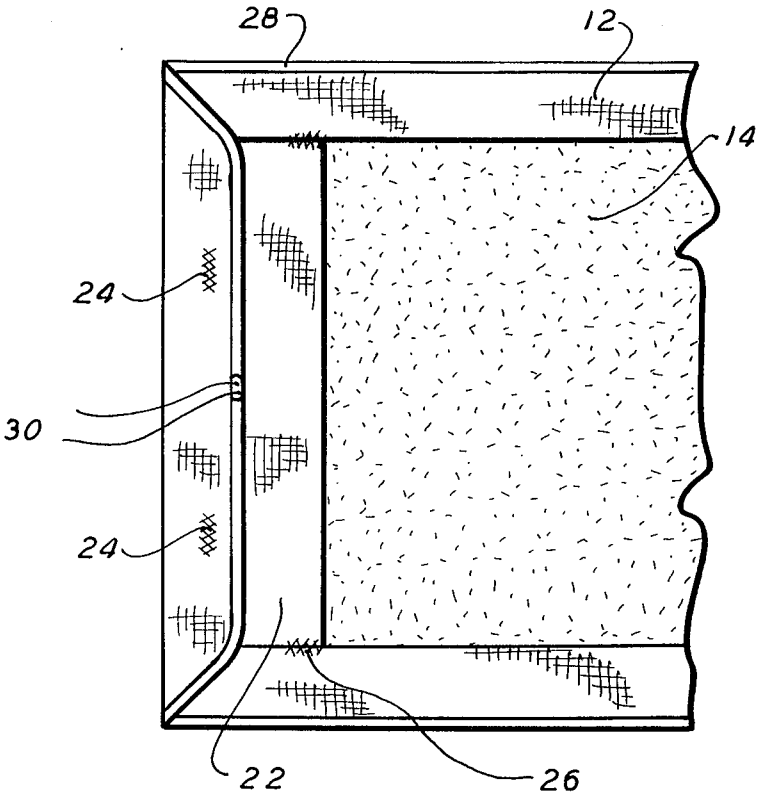
FIG. 6 is a fragmentary portion of the heel end of a cover.
Figure 5:
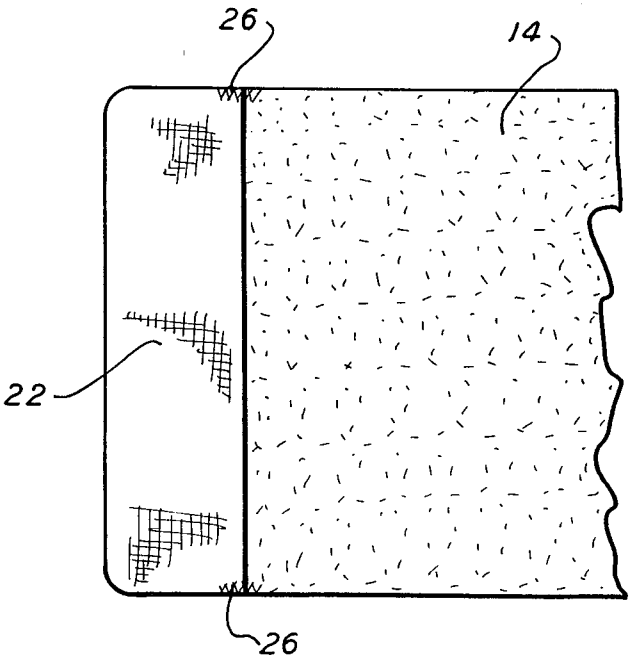
FIG. 5 is a fragmentary portion of the heel portion of the pad sheet.
Figure 11:
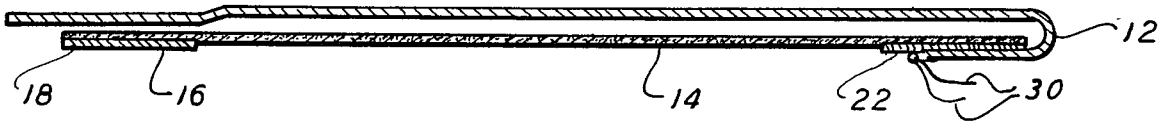
FIG. 11 is a cross sectional elevational view of the device of FIG. 2 taken at 11—11 with the drawstring and housing therefore ommitted for clarity.

The nose portion 16 which envelopes a minor forward arcuate segment of the pad sheet 14 may be made of either a substantially unstretchable fabric, of a stretchable pad and other stretchable material. Where a substantially unstretchable fabric is utilized, it is preferable to size the nose portion 16 so as to allow for the thickness of the ironing board. This may be accomplished by slightly widening the nose portion 16 or by inserting pleats 34 in the nose portion 16 as shown in FIG. 4.

Figure 7:
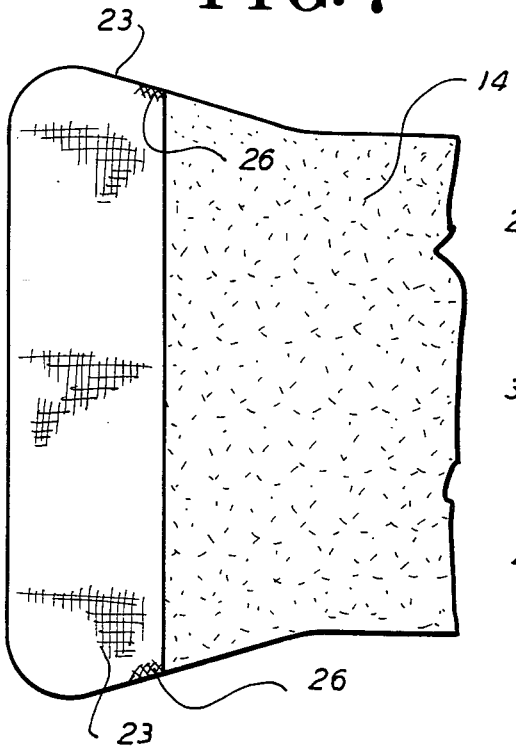
FIG. 7 is a fragmentary portion of the heel portion of the pad sheet wherein the heel portion is flared.
Figure 8:
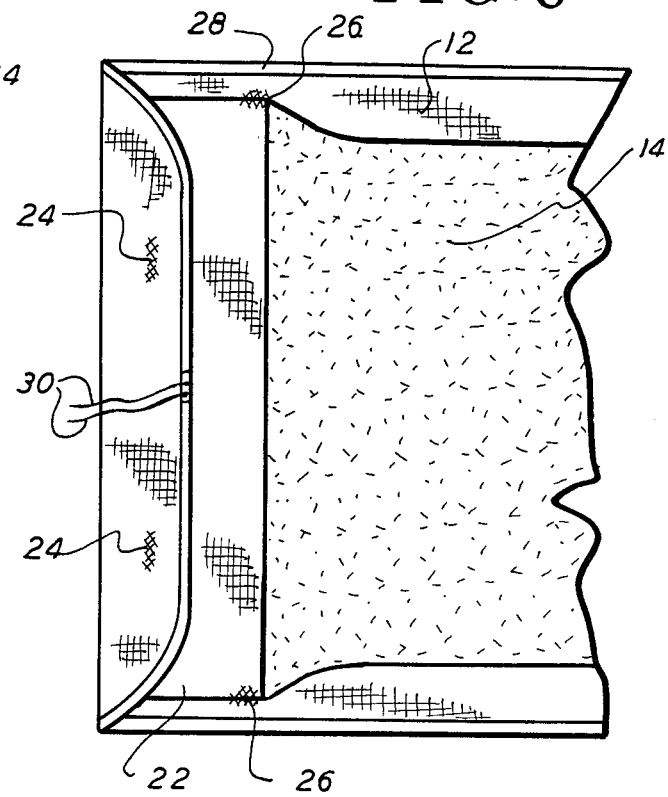
FIG. 8 is a fragmentary portion of the heel end of a cover wherein the heel portion is flared.
Figure 9:
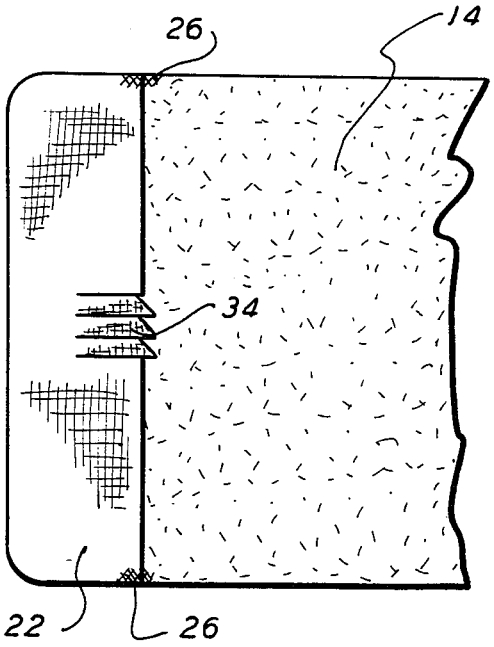
FIG. 9 is a fragmentary portion of the heel portion of the pad sheet wherein the heel portion is pleated.
Figure 10:
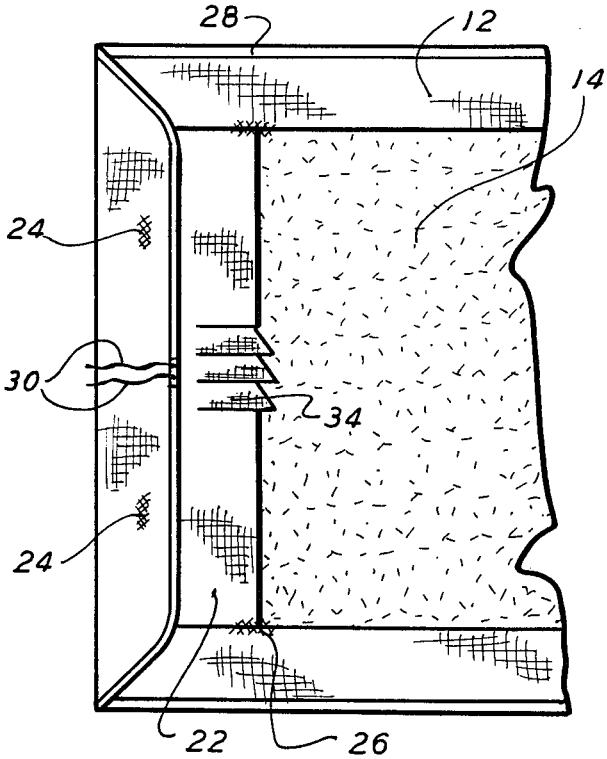
FIG. 10 is a fragmentary portion of the heel end of a cover wherein the heel portion is pleated.

Similarly, the heel portion 22 which envelopes a minor rearward arcuate segment of the pad sheet 14 may be made of either a substantially unstretchable fabric, of a stretachable pad or other stretchable material. Where a substantially unstretchable fabric is utilized, it is preferable to size the heel portion 22 so as to allow for the thickness of the ironing board. This can be accomplished by widening the heel portion 16 relative to the width of the pad sheet 14. Alternatively, the pad sheet 14 and the heel portion 22 can be shaped into a flare shape 23 as shown in FIGS. 7 and 8. This will allow for the extra width needed. A third alternate, as shown in FIGS. 9 and 10, is to provide the heel portion 22 with pleats 34 so as to accomodate the thickness of the board while allowing sufficient "give" to fit the cover onto the board.

The heel and nose portions 22 and 16 are rigidly affixed to the pad sheet 14 around a portion of the periphery of the curved edge of their respective arcs. This may be accomplished be gluing, sewing or, in the case where the heel and nose portions 22 and 16 are fabricated of pad, by heat or chemical sealing.

The forward reinforcing means 20 and the rearward reinforcing means 26 are necessary to protect the tear points at their respective locations. Typically, the reinforcing means will be zig-zag stitching, but other conventional reinforcing means such as seam binding or box stitching can also be utilized.

The nose portion 16 is affixed to the surface sheet 12, typically at its apex, utilizing zig-zag stitching. Other attachment means may, of course, be utilized. The attachment also preferably goes through the portion of the pad sheet 12 underlying the nose portion 12. While not critical, attachment to the surface sheet 12 at tear points 20 is desirable.

The heel portion 22 is affixed to the lower face of the surface sheet 12 at at least one position 24 on the heel portion 22, said position 24 being located forwardly of the rearward edge of said heel portion 22. The position 24 of attachment of the lower face of the surface sheet 12 to the heel portion 22 is preferably distanced from between about one-third to one-half of the distance from the rear of the heel portion 22 to its forward edge. This attachment 24 does not go through the upper surface portion of the pad sheet 12 underlying the heel portion 22 to the lower surface of surface sheet 12. Rather the surface sheet 12 is folded so as to overlay a portion of the heel portion 22 with its lower face in contact with the lower face of heel portion 22 and attached at position 24. This enables the surface sheet 12 to be properly positioned on the ironing board when the nose portion of the board is inserted into the nose envelope formed by the nose portion 16 and the underlying pad sheet 12 and the heel portion of the board, by rearward pulling of the heel envelope formed by the heel portion 22 and the underlying pad sheet 12, is slipped into same.

The manufacture of the cover of the present invention proceeds in a conventional manner. Thus, the various components are hand- or machine- cut and then assembled using conventional stitching, gluing, heat- or chemical sealing techniques.

While preferred embodiments have been shown and described, it will be appreciated that other modifications may be made without departing from the spirit and scope of the invention.

I claim:

1. A form-fitting cover for use on an ironing board comprising a substantially non-elastic fabric ironing surface sheet, a stretchable, substantially heat resistant pad sheet disposed below said surface sheet, said surface sheet being dimensioned to be larger than a standard ironing board so that when fitted to such a board it will fit over the upper surface thereof around its edges and just around the perimeter of its lower surface, the pad sheet having a breadth dimension substantially equal to that of the breadth dimensions of the board but having a length dimension between 0.5% and 10% less than that of the board, a nose portion, enveloping a minor forward arcuate segment of said pad sheet, said nose portion being rigidly affixed to said pad sheet around a portion of the periphery of the curved edge of said arc and additionally being affixed to said surface sheet at at least one position proximate to the periphery of the curved edge of said arc, said peripheral attachment of the forward and rearward arcuate segments of said pad sheet to said nose portion and to said heel portion and the location of the said attachment of said nose portion to said surface sheet respectively being the only sectors of attachment of said pad to the other components of said cover, forward reinforcing means located forwardly of the rearward edge of said nose portion at the common peripheral edge of said nose portion and said pad sheet, a heel portion, having a rearward segment, said segment enveloping a minor rearward arcuate segment of said pad sheet, said heel portion being rigidly affixed to said pad sheet around a portion of the periphery of the curved edge of said arc, the upper face of said heel portion being affixed to the lower face of said surface sheet at at least one position on said heel portion, said position located forwardly of the rearward edge of said heel portion, and rearward reinforcing means located rearwardly of the forward edge of said heel portion at the common peripheral edge of said heel portion and said pad sheet, whereby when the said nose portion of the board is inserted into the nose portion of the pad sheet by rearward pulling of the heel portion, the same is slippable over the heel of the board giving a snug fit of the pad sheet thereon.

2. A cover of claim 1 wherein the heel and nose portion are made of substantially unstretchable fabric.

3. A cover of claim 2 wherein the forward and rearward reinforcing means are zig-zag stitches.

4. A cover of claim 2 wherein the width of the heel fabric is greater than the width of the sector of pad to which it is attached.

5. A cover of claim 4 wherein the heel fabric is pleated.

6. A cover of claim 1 wherein the heel and nose are made of stretchable pad.

7. A cover of claim 1 additionally comprising a drawstring housing around the circumference of the surface sheet and a drawstring therein for securing the cover to the ironing board.

8. A cover of claim 1 additionally comprising an elastic material around the circumference of the surface sheet for securing the cover to the ironing board.

9. A cover of claim 1 wherein the location of attachment of the lower face of the surface sheet to the heel is distanced from between about one-third to one-half of the distance from the rear of the heel to its forward edge.

10. A cover of claim 1 wherein the length of the pad sheet is between 2.5% and 5% less than the length of the board.

* * * * *